US005664409A

United States Patent [19]

Lorenz

[11] Patent Number: 5,664,409

[45] Date of Patent: Sep. 9, 1997

[54] METHOD OF CONTROLLING THE TENSION OF AN ADVANCING YARN

[75] Inventor: Hellmut Lorenz, Remscheid, Germany

[73] Assignee: Barmag AG, Remscheid, Germany

[21] Appl. No.: 670,554

[22] Filed: Jun. 27, 1996

[30] Foreign Application Priority Data

Jun. 30, 1995 [DE] Germany ..... 195 23 995.4

[51] Int. Cl.[6] ..... D01H 7/92; D02G 1/06

[52] U.S. Cl. ..... 57/264; 57/100; 57/332

[58] Field of Search ..... 57/100, 264, 280, 57/283, 332

[56] References Cited

U.S. PATENT DOCUMENTS

| | | | |
|---|---|---|---|
| 3,791,128 | 2/1974 | Landwehrkamp et al. | 57/93 |
| 3,842,578 | 10/1974 | Schippers | 57/34 HS |
| 4,015,414 | 4/1977 | Sholly | 57/34 HS |
| 4,248,038 | 2/1981 | Takai | 57/336 |
| 4,339,915 | 7/1982 | Dammann et al. | 57/339 |
| 4,720,702 | 1/1988 | Martens | 340/677 |
| 4,896,407 | 1/1990 | Haynes | 28/248 |
| 4,961,308 | 10/1990 | Braxmeier | 57/328 |
| 5,146,739 | 9/1992 | Lorenz | 57/264 |
| 5,369,945 | 12/1994 | Wessolowski et al. | 57/264 |
| 5,440,870 | 8/1995 | Neumann . | |

FOREIGN PATENT DOCUMENTS

| | | |
|---|---|---|
| 33 06 594 | 11/1983 | Germany . |
| WO92/11535 | 7/1992 | WIPO . |

*Primary Examiner*—William Stryjewski

*Attorney, Agent, or Firm*—Bell, Seltzer, Park & Gibson, P.A.

[57] ABSTRACT

A method is described for controlling the tension of an advancing yarn, which is crimped in a friction false twist unit of a false twist crimping machine. In accordance with the method, the tension of the advancing yarn is measured downstream of the friction false twist unit and the yarn tension is converted via a time filter and by comparison with a predetermined desired value into an adjustment signal for correcting the friction false twist unit, the control range being determined by defined limit values of the adjustment signal. The adjustment signal is a current value and is corrected adaptively via a PI controller, the control behavior of which takes into account the quotient from the change of the yarn tension and the change of the current value of the adjustment signal.

14 Claims, 6 Drawing Sheets

METHOD OF CONTROLLING THE TENSION OF AN ADVANCING YARN

BACKGROUND OF THE INVENTION

The invention relates to a method of controlling the tension of an advancing yarn and which is adapted for use in a yarn false twist texturizing process.

DE 33 06 594 discloses a method of false twist texturing an advancing yarn, in which the twist torque imparted by the friction false twist unit to the yarn is adjusted as a function of the tension, in that the contact pressure of two surfaces acting upon the yarn is adjusted accordingly. This method allows the yarn tension to be adjusted to a constant value. The disadvantage of this method resides in the fact that fluctuations of the mean value are no longer obvious and, therefore, defects or errors that are to be detected by measuring the yarn tension can no longer be detected. For example, changes in the yarn tension may occur as a result of the wear of a feed system or errors in the temperature control of the texturing zone. However, these defects cannot be detected by the known method. Instead, these defects are corrected and thereby hidden.

EP 0 439 183 discloses a method of monitoring the tension of an advancing yarn in the texturing zone of a false twist crimping machine, wherein the yarn tension is corrected in that same is converted, via a time filter, into an adjustment signal, which controls the magnitude and/or the distribution of components of the frictional force exerted by the false twist unit on the yarn, the adjustment signal being used as a signal representing the continuous mean value of the continuously measured value for purposes of monitoring the quality. The adjustment signal which corrects the yarn tension is thus monitored to the effect, whether or not it leaves a predetermined range between an upper limit value and a lower limit value. These limit values are used to release an alarm signal, should the adjustment signal leave the range between these limit values. In addition, the difference between the actually measured yarn tension may be compared with the adjustment signal after a corresponding conversion, and an alarm signal may be released, should the difference signal leave a predetermined range between an upper and a lower limit value.

As described in WO 92/11535, a method of controlling the tension of an advancing yarn downstream of the friction false twist unit of a false twist crimping machine is based on the method described in EP 0 439 183, which relates to the adjustment for the control of the yarn tension in the twisting zone. A twist/advance ratio (D/Y) defined as quotient from the active radius of the friction false twist unit and the yarn speed is adjusted, in that the point of engagement of the yarn on the friction false twist unit and/or the yarn speed are adjusted.

Furthermore, EP 0 207 471 describes a method of monitoring the quality of an advancing yarn. This method serves primarily the purpose of detecting the defects that occur in the method described in DE 33 06 594.

In all the known methods or the prior art apparatus operating by these methods, it has been found that, while the numerous, individual friction false twist units of a false twist crimping machine are all of the same construction, the yarn tension surprisingly varies in the different positions, i.e. the different friction false twist units, or even over time. As a result, it is not possible to produce, even with a single false twist crimping machine, crimped yarns of consistent quality.

It is therefore the object of the present invention to provide a method of controlling the tension of an advancing yarn downstream of the friction false twist unit of a false twist crimping machine, which permits local and chronological variations in the crimp quality of the yarn to be minimized.

SUMMARY OF THE INVENTION

The above and other objects and advantages of the present invention are achieved by the provision of a yarn false twist texturizing process which comprises steps of advancing the yarn through a false twist unit which acts to impart a frictional force to the yarn which includes a twisting component and a tension component. The tension of the advancing yarn is monitored and a signal (T) is generated which is representative of the monitored tension. The generated tension signal is processed through a time filter to produce a time averaged signal (LW), and the time averaged signal (LW) is compared with a set point signal (Soll) to produce an adjusting signal (VS) which represents the difference therebetween.

The adjusting signal is then corrected as a function of a disturbance variable (Z) acting upon the false twist unit, and the operation of the false twist unit is controlled so that the frictional force imparted to the advancing yarn varies as a function of the value of the corrected adjusting signal.

In one embodiment, the correcting step includes correcting the adjusting signal as a function of the ratio of the yarn tension (T) to a manipulated variable (S) at a monetary working point (B). In another embodiment, the correcting step includes correcting the adjusting signal as a function of the ratio of the yarn tension (T) to the adjusting signal (VS) at a monetary working point (B).

In accordance with the invention, the method of controlling the tension of an advancing yarn downstream of a friction false twist unit of a false twist crimping machine is characterized in that a controller constant is corrected during the continuous process, i.e., during the control. The special advantage of this procedure is to be seen in that each processing station adjusts itself individually to the environmental conditions, such as, for example, apparatus tolerances, wear, yarn speed, etc., which act as disturbance variables.

The previously known methods have always used a certain, predetermined controller constant for controlling the yarn tension. This controller constant has been obtained, for example, by measuring a family of characteristics of a control zone. In this process, the optimal controller constant has been determined only for a certain working point. In practice, however, it has been found that the relation between the manipulated variable on the false twist unit and the yarn tension differs on each processing station. Furthermore, it is necessary to likewise consider the operation-conditioned changes of the disturbance variables, such as, for example, wear and yarn speed. Since upon a change of the manipulated variable or the disturbance variable, a new static operating condition results after a dynamic transition, no optimal control has been achieved until now. This is now accomplished by the method of the present invention, since the controller constant is corrected during the control as a function of the disturbance variable acting upon the friction false twist unit or a control zone. The influence of the disturbance variable may be determined from the relation between the yarn tension and the disturbance variable at the momentary working point or from the relation between the yarn tension and the adjustment signal at the working point. A corrected controller constant may be determined with reference to a predetermined performance graph of the controller. The performance graph of the controller provides the relation between the controller constant and the inclination or slope, which results from the division of the difference in the yarn tension between two instants and the difference in the manipulated variables or adjustment signals at these instants. The performance graph may be determined by measurements or by empirical calculations and be input in the machine. This allows to determine with the new slope value the corrected controller constant associated to this working point, which is supplied as a corrected value to the controller. Thus, it is accomplished that both the dependencies between the manipulated variable and controller variable, which vary from processing station to processing station, and the dependency on the disturbance variables do not affect the yarn quality. As a result, the controllers of each texturing station have their individual controller constants. The controller constant is not determined continuously, but in the case of need or in accordance with certain time patterns.

Preferably, in the method of controlling the tension of an advancing yarn, the angle between the direction of the advancing yarn and the direction of movement of the friction surface of the friction false twist unit is measured as a manipulated variable. Besides using the angle as a manipulated variable, it is also possible to measure the spacing between the axes of the friction shafts for use as a manipulated variable. Since the contact pressure of the friction surfaces exerts an influence on the tension of an advancing yarn, it is suggested that the contact pressure of the friction surfaces be measured for use as a manipulated variable. In accordance with a further advantageous concept, it is suggested that the speed of the yarn be measured as a disturbance variable.

The correction of the controller constant occurs via a control, the control deviation of the yarn tension being adjusted as a function of the control constant. To control the yarn tension, it is preferred to use a PI controller. The PI controller has an integral action factor and a proportional control factor, which influence the behavior of the controller. The two factors exert a different influence on the controller. If the PI controller is too sensitive, this sensitivity may be influenced by changing the integral action factor. If the controller is too sluggish, the proportional control factor may be increased. In this connection, it should be noted, on the one hand, that the controller does not reach an unstable state or, on the other hand, that it does not become too slow and too sluggish.

In a preferred embodiment, the control behavior of the PI controller is influenced at defined time intervals, which may be very large. This means that the influencing may occur very slowly. In another preferred embodiment, the influencing of the control behavior may ideally occur automatically via a control.

BRIEF DESCRIPTION OF THE DRAWINGS

Further advantages and possible applications of the invention are described in more detail with reference to the attached drawings, in which.

DETAILED DESCRIPTION OF THE PREFERRED EMBODIMENTS

Figure 1:
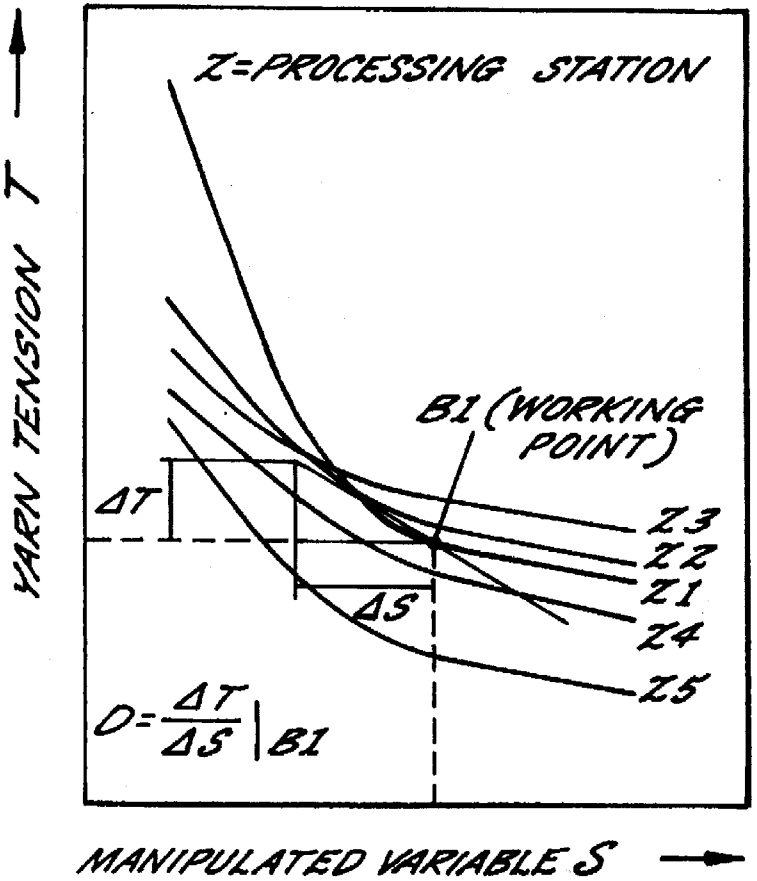
FIG. 1 is a diagram of the dependency of the yarn tension on a manipulated variable S, the diagram illustrating the differences of individual friction false twist units.

Illustrated in FIG. 1 is a diagram of the yarn tension with respect to a manipulated variable S, the diagram illustrating for the position curves indicated therein as parameters that different curves of the yarn tension with respect to the manipulated variable S result for different friction false twist units of a false twist crimping machine. This surprising result is all the more remarkable, inasmuch as identical constructional components and the same type of control are used for all friction false twist units. FIG. 1 also shows the determination of a slope D at a working point B1. The slope D is formed by the quotient from the difference of the yarn tension $\Delta T$ to $\Delta S$. The slope D may also be formed as a differential of the yarn tension T as a function of the manipulated variable S at the working point B1.

Figure 2:
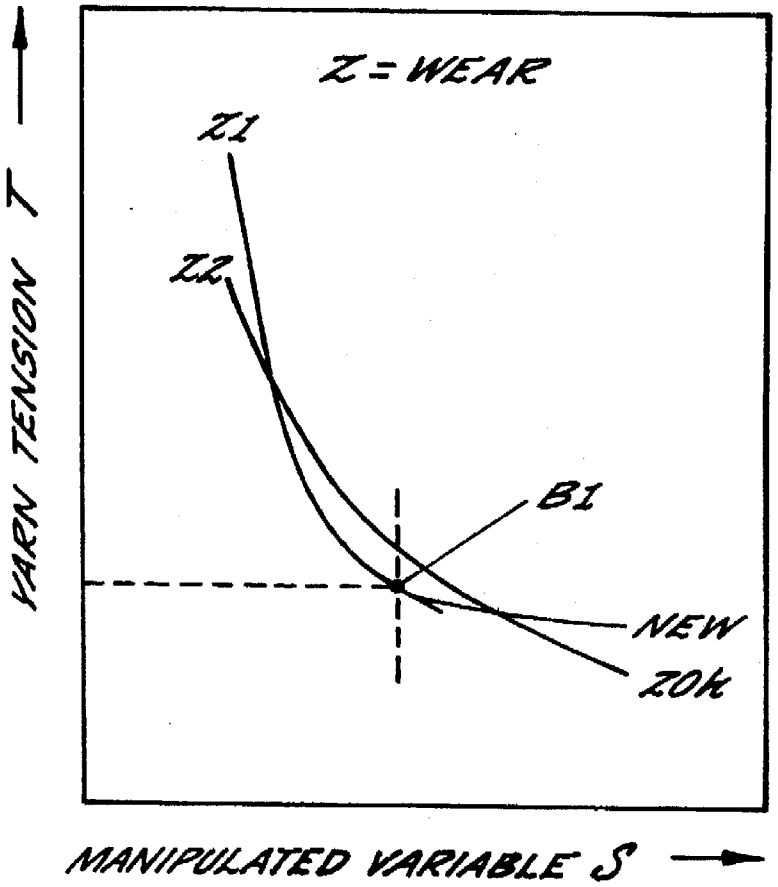
FIG. 2 is a diagram of the yarn tension above the manipulated variable S, the diagram illustrating a variation in time of the yarn tension on a friction false twist unit.

In similar manner, FIG. 2 is a diagram of the yarn tension T with respect to a manipulated variable S. This diagram shows that upon the startup of a new friction false twist unit, the relation between yarn tension and manipulated variable S takes approximately a hyperbolical course, whereas after an operating time of 20 hours, this course becomes clearly straighter and approximates more the course of a straightline.

Figure 3:
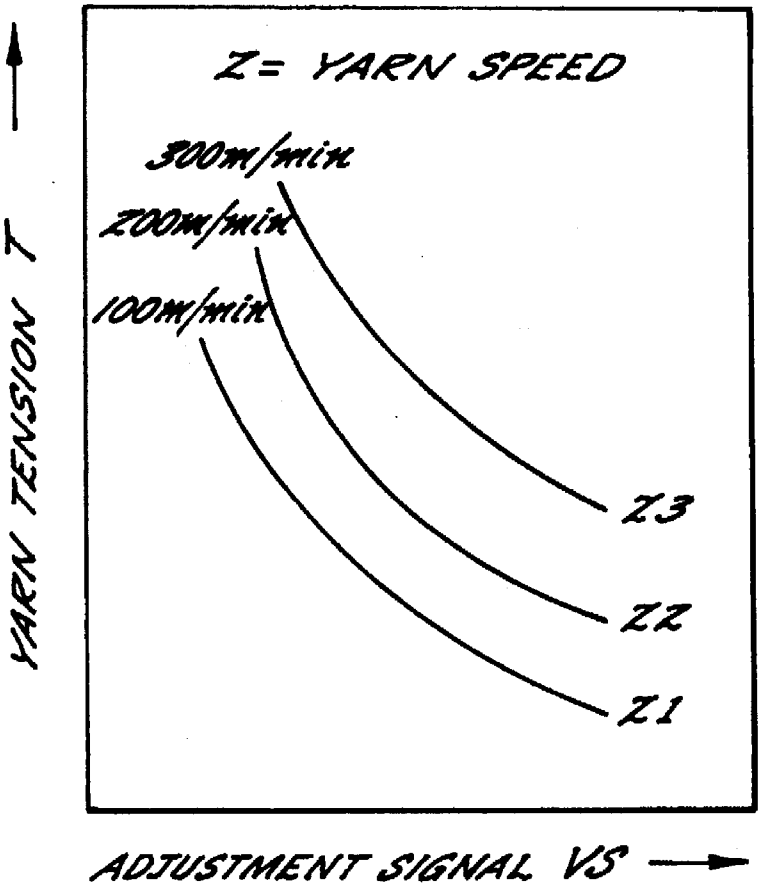
FIG. 3 is a diagram of the yarn tension above an adjustment signal VS as a function of the yarn speed.

FIG. 3 is a diagram which illustrates the dependency of the yarn tension T on an adjustment signal VS. The yarn tension decreases as the adjustment signal VS increases. It can also be noted from the diagram that with a constant adjustment signal VS, the yarn tension becomes greater as the yarn speed increases.

Figure 4:
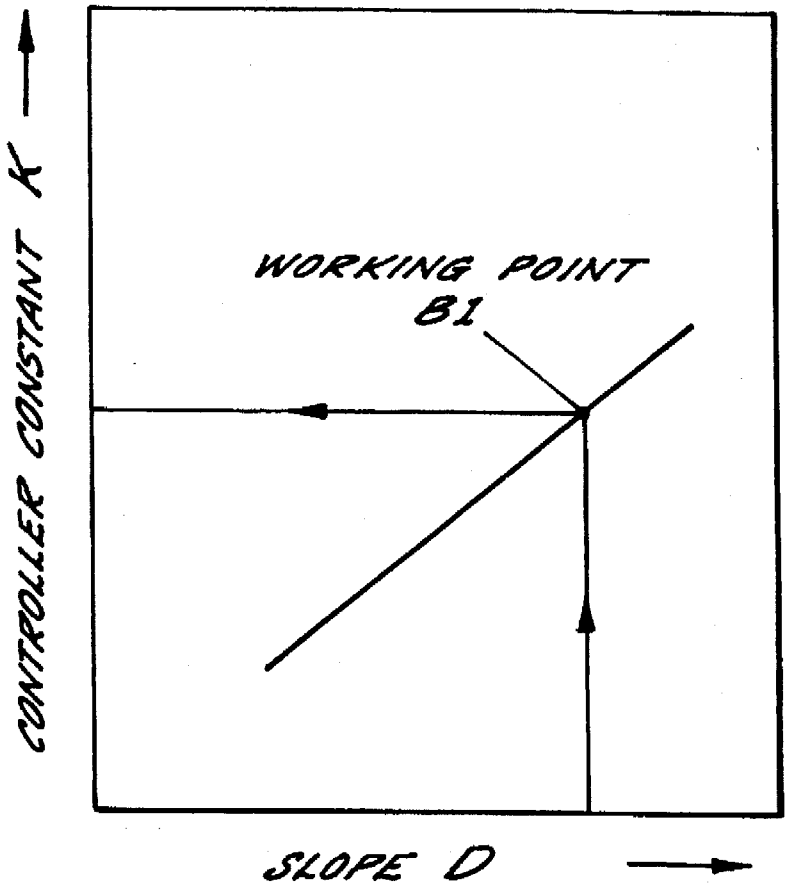
FIG. 4 is a performance graph of the controller.

FIG. 4 illustrates a performance graph of the controller, which reflects the relation between a controller constant K and the slope D. The performance graph of the controller is determined by measurements or by empirical calculations and input in the machine. From the performance graph of the controller, it is then possible to determine with the newly determined slope D the controller constant K that is associated to this working point and then supplied as a corrected value KR to the controller.

Figure 5:
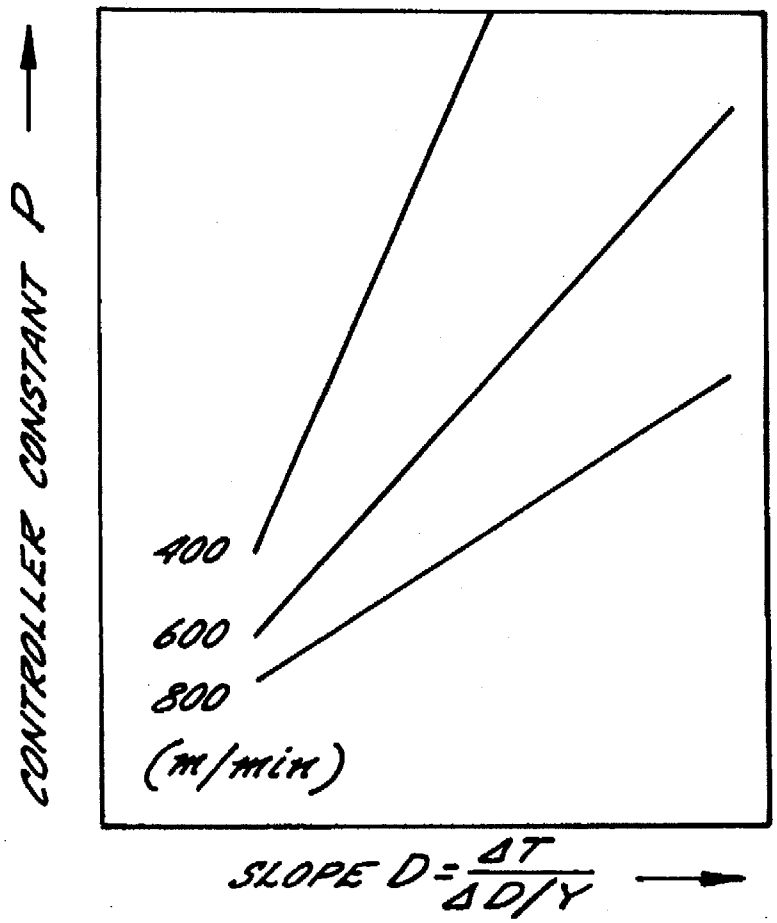
FIG. 5 is a diagram of the dependency of the proportional control factor of the controller as a function of the slope $\Delta T/(\Delta D/Y)$.

FIG. 5 is a diagram which illustrates the dependency of the proportional control factor of the controller on the quotient $\Delta T(\Delta D/Y)$ which is described as slope. As can be noted from this diagram, the proportional control factor increases considerably not only with the slope, but also rises very considerably as the yarn speed decreases. The quotient defined as slope expresses the change in the yarn tension as a function of the change in the twist/advance ratio, the latter being the ratio of the active diameter D of the disks in the friction false twist unit to the yarn speeds.

Figure 6:
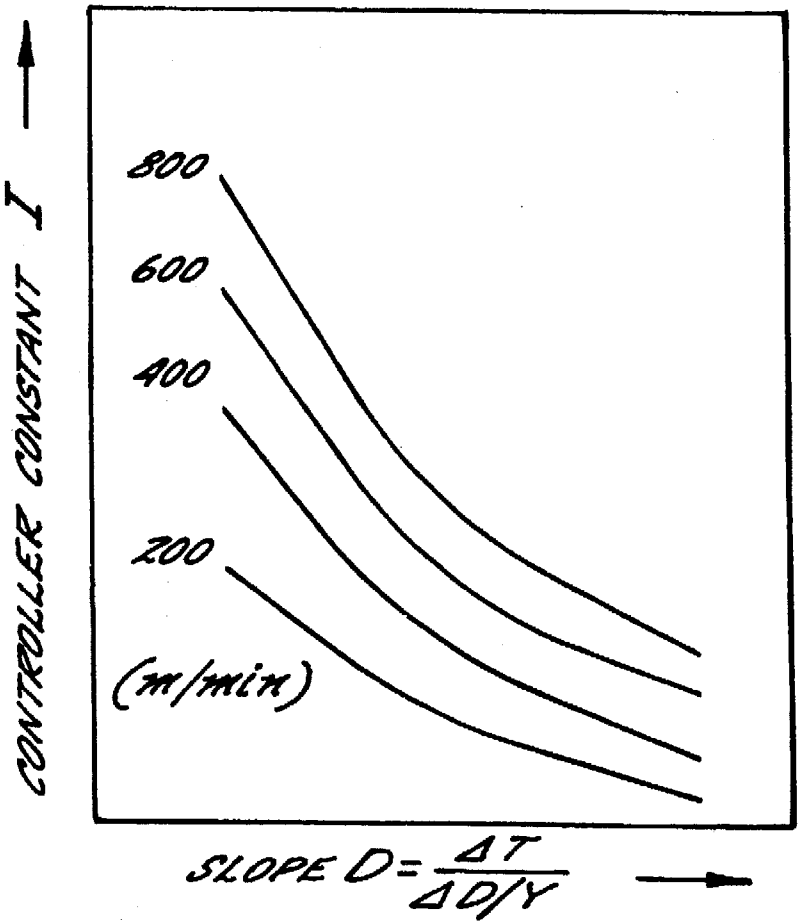
FIG. 6 is a diagram of the dependency of the integral action factor of the controller on the slope $\Delta T/(\Delta D/Y)$.

Shown in FIG. 6 is a diagram for illustrating the integral action factor of the controller as a function of the slope. The integral action factor rises as a function of the yarn speed. As the slope increases, the integral action factor drops. As can be noted from FIGS. 5 and 6, the proportional control factor P falls at increasing yarn speed, when related to a defined slope D, whereas the integral action factor I increases.

Figure 7:
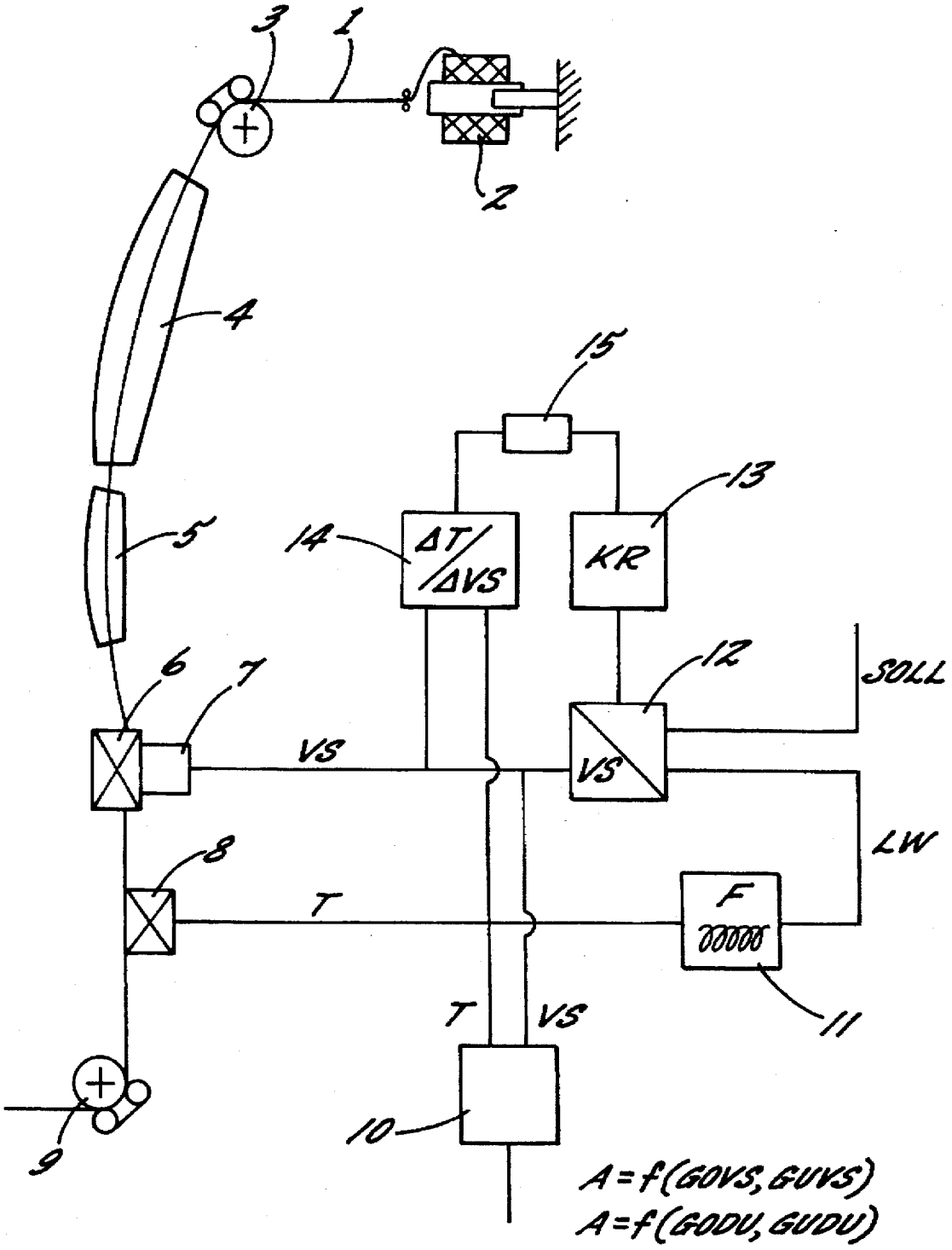
FIG. 7 is a schematic view of a processing station in a false twist crimping machine in accordance with the invention.

FIG. 7 is a schematic view of a processing station in a false twist crimping machine. A synthetic filament yarn 1 is withdrawn by a first feed system 3 from a supply package 2. A texturing zone is formed between the first feed system 3 and a second feed system 9. It comprises primarily an elongate heater 4, a cooling rail 5, and a friction false twist unit 6. The friction false twist unit has two endlessly moved surfaces, which move transversely to the yarn axis, and which are contacted by the yarn. Preferably, these endlessly moved surfaces are formed by disks with rounded outer edges. These surfaces impart to the yarn a twist in direction of the first feed system, which untwists again in direction of the second feed system 9.

Arranged between the friction false twist unit 6 and second feed system 9 is an instrument 8 for measuring the yarn tension, which emits the yarn tension T as an output signal. Not shown in FIG. 7 is a takeup arranged downstream of the second feed system 9 or an intermediate treatment zone by heating, which may likewise be arranged downstream thereof, if need arises.

The output signal T of instrument 8 for measuring the yarn tension, which represents the yarn tension T, is converted via a filter 11 into a time averaged signal LW. The time averaged signal LW is supplied together with a desired or set point value Soll to a controller 12. In controller 12, the desired value and the time averaged signal are compared and converted into an adjustment value VS. On the basis of this adjustment value, the proportional control factor and/or the integral action factor of the controller are influenced via a PI controller 13, the control behavior of which influences by considering the ratio of the change of yarn tension to the change of a current value corresponding to one of the adjustment values. A timer 15 is provided for activating the PI controller 13 at selected time intervals.

The thus-corrected adjustment value is supplied to a final control element 7 of friction false twist unit 6, the final control element 7 controlling the twist that is imparted by the friction false twist unit 6 to the yarn 1. The output signal T of instrument 8 for measuring the yarn tension is supplied, as is the adjustment signal, to an evaluation unit 10. In evaluation unit 10, the adjustment signal represents the adjustment signal of the yarn tension that has been corrected by the PI controller 13 by the ratio $\Delta T/\Delta L$ The evaluation unit 10 supplies an evaluation of the actual output signal T, which represents the actually measured yarn tension in accordance with the principles described in EP 207 471.

This means that evaluation unit 10 stores an upper limit value GOVS and a lower limit value GUVS for adjustment signal VS. Should the adjustment signal VS exceed one of these limit values, an alarm signal will preferably be released. Furthermore, in evaluation unit 10, a difference value DU between the actual output signal T and the adjustment signal VS is formed, after both have previously been converted into compatible, comparative values. Finally, evaluation unit 10 stores an upper limit value GODU and a lower limit value GUDU of this difference signal DU. Preferably, an alarm signal A will be emitted, should the difference signal DU between the adjustment signal and the actual output signal T exceed one of the limit values GODU, GUDU.

Figure 8:
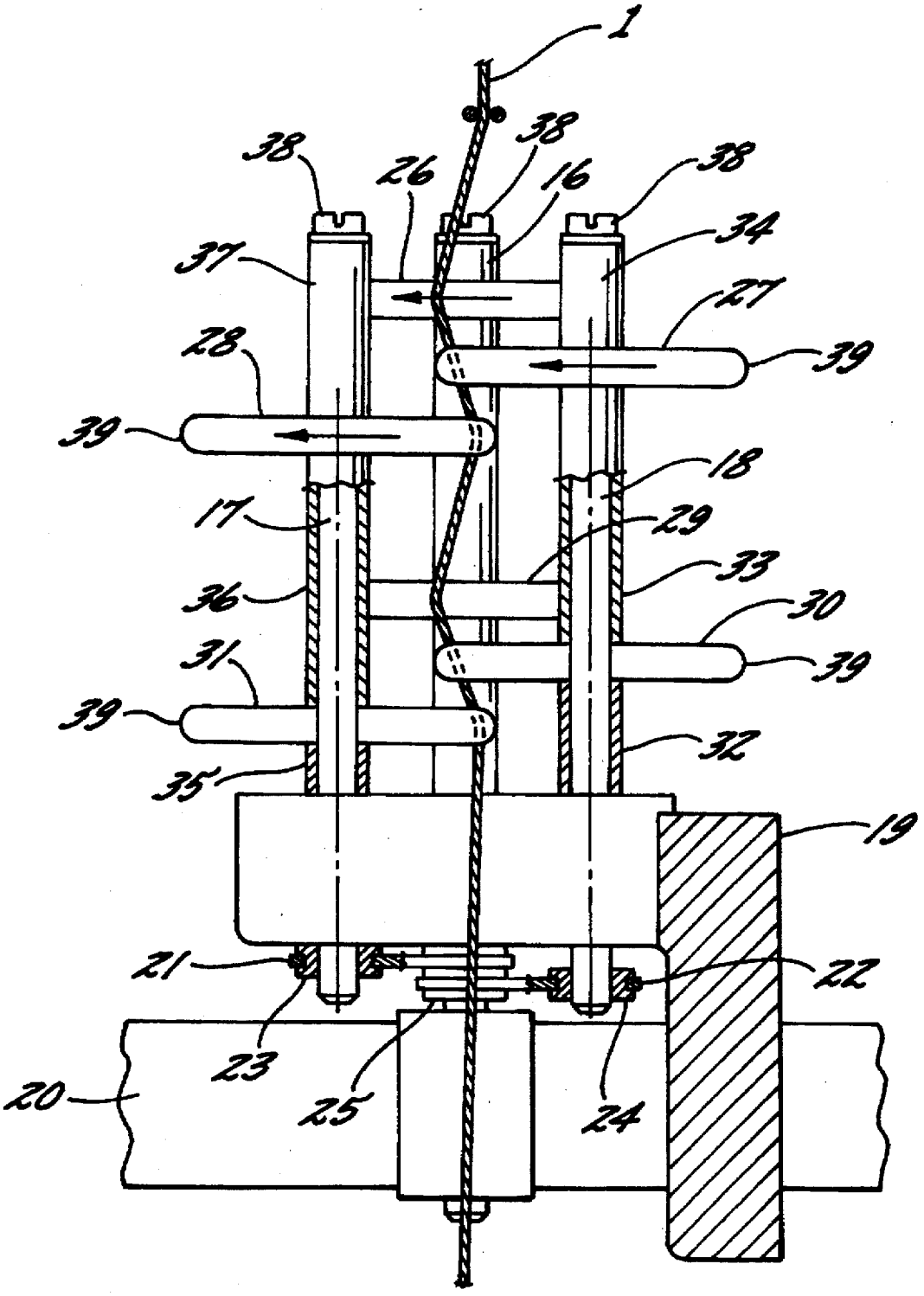
FIG. 8 illustrates an embodiment of a friction false twist unit.
Figure 9:
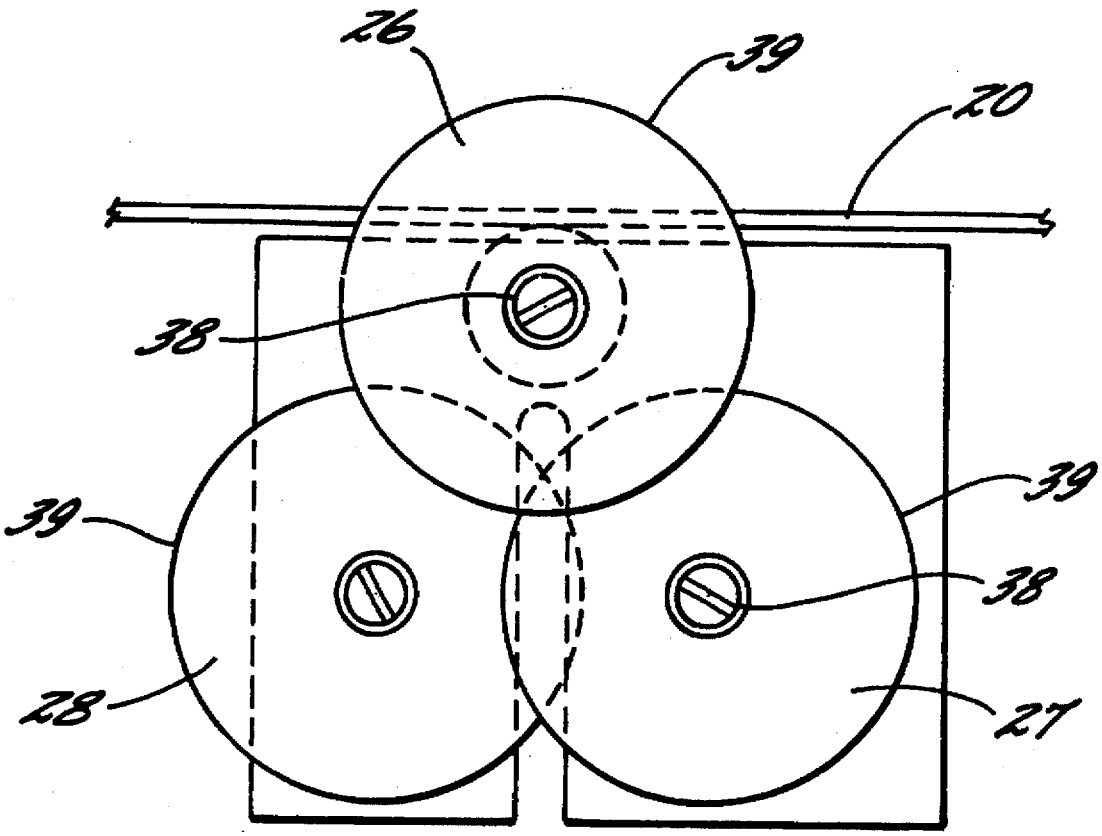
FIG. 9 is a top view of the friction false twist unit.

The friction false twist unit 6, as shown in FIGS. 8 and 9, has three parallel shafts 16, 17, and 18 arranged in the corners of an equilateral triangle. The shafts 16, 17, and 18 are supported for rotation in a frame 19. The shaft 16 serves as a drive shaft which is driven by a drive belt 20. From shaft 16, the rotation is transmitted by two drive belts 21, 22 which extend over belt pulleys 23, 24, and 25. The belt pulley 23 is arranged on shaft 17, belt pulley 24 on shaft 18, and belt pulley 25 on shaft 16. The belt pulley 25 is constructed as a twin belt pulley, so that it guides drive belts 21, 22.

In the illustrated embodiment, the friction false twist unit 6 is provided with two groups of disks 26, 27, 28; 29, 30, 31, the number of disks 26, 27, 28; 29, 30, 31 of each group corresponding to the number of rotating shafts 16, 17, 18. Accordingly, the first group comprises disks 26, 27, 28, and the second group disks 29, 30, 31. The disks of each group follow one another in the direction of the advancing yarn at respectively the same distance.

The disks 26, 27, 28; 29, 30, 31 are connected with the shafts 16, 17, 18 in frictional or formfitting engagement. However, each disk may be removed from its shaft. To adjust and maintain the spacing between disks 26, 27, 28, 29, 30, 31 of a shaft 16, 17, 18, different spaces 32, 33, 34, 35, 36, 37 in the form of sleeves are slipped over each shaft 16, 17, 18. To axially secure the spacers 32, 33, 34, 35, 36, 37 and the disks 26, 27, 28, 29, 30, 31, screws 38 are provided in the head of each shaft 16, 17, 18. The spacings between the shafts and the disk diameters are laid out such that, as shown in FIG. 9, disks 26, 27, 28 and disks 29, 30, 31 overlap one another. This overlap forms a so-called "overlapping triangle" with arcuate sides. Between the sides of this triangle, the yarn 1 is urged to advance along a helix as it passes through the friction false twist unit between the groups of disks. It is possible to use a friction false twist unit with more than three disks and, thus, with more than three shafts for each group of disks. Each disk 26, 27, 28, 29, 30, 31 has a friction surface 39.

In the method of controlling the tension of an advancing yarn 1, the angle between the direction of the advancing yarn and the direction of movement of friction surface 39 is measured as a manipulated variable. Besides the angle as a manipulated variable, it is also possible to measure the spacing between the shafts 16, 17, 18, as a manipulated variable. Since the contact pressure of the friction surfaces 39 exerts an influence on the tension of an advancing yarn, the contact pressure of the friction surfaces may also be measured as a manipulated variable.

In the drawings and the specification, there has been set forth preferred embodiments of the invention, and, although specific terms are employed, the terms are used in a generic and descriptive sense only and not for the purpose of limitation, the scope of the invention being set forth in the following claims.

That which is claimed is:

1. A yarn false twist texturizing process comprising the steps of advancing a yarn through a false twist unit which acts to impart a frictional force to the yarn which includes a twisting component and a tension component, monitoring the tension of the advancing yarn and generating a signal (T) representative of the monitored tension, processing the generated tension signal through a time filter to produce a time averaged signal (LW), comparing the time averaged signal (LW) with a set point signal (Soll) and producing an adjusting signal (VS) representing the difference therebetween, correcting the adjusting signal as a function of a disturbance variable (Z) acting upon the false twist unit, and controlling the operation of the false twist unit so that the frictional force imparted to the advancing yarn varies as a function of the value of the corrected adjusting signal.

2. The yarn false twist texturizing process as defined in claim 1 wherein the correcting step includes correcting the adjusting signal as a function of the ratio of the yarn tension (T) to a manipulated variable (S) at a momentary working point (B).

3. The yarn false twist texturizing process as defined in claim 1 wherein the correcting step includes correcting the adjusting signal as a function of the ratio of the yarn tension (T) to the adjusting signal (VS) at a momentary working point (B).

4. The yarn false twist texturizing process as defined in claim 1 wherein the correcting step includes the steps of a) measuring a manipulated variable (S1) or the adjustment signal (VS1) and the yarn tension (T) at an instant (t1);

b) measuring a manipulated variable (S2) or the adjustment signal (VS2) and the yarn tension (T2) at an instant (t2);

c) defining a slope D=(T1–T2)/(S1–S2) or D=(T1–T2/(VS1–VS2); and d) determining a corrected controller constant (KR) from a predetermined performance graph of the controller.

5. The yarn false twist texturing process as defined in claim 4, wherein the performance graph is determined empirically by measuring or computation.

6. The yarn false twist texturing process as defined in claim 5, wherein the rotational speed of the friction false twist unit or the ratio of rotational speed to yarn speed is measured as the manipulated variable (S).

7. The yarn false twist texturing process as defined in claim 5, wherein the angle between the direction of the advancing yarn and the direction of movement of the friction surface or surfaces of the friction false twist unit is measured as the manipulated variable (S).

8. The yarn false twist texturing process as defined in claim 5, wherein the false twist unit comprises a plurality of parallel friction shafts and wherein the center to center distance between the friction shafts is measured as the manipulated variable (S).

9. The yarn false twist texturing process as defined in claim 5, wherein the false twist unit comprises a plurality of friction surfaces and wherein the contact pressure of the friction surfaces is measured as the manipulated variable (S).

10. The yarn false twist texturing process as defined in claim 5, wherein the false twist unit comprises a plurality of friction surfaces and wherein the angle of entry between the friction surfaces and the yarn is measured as the manipulated variable (S).

11. The yarn false twist texturing process as defined in claim 1, wherein the yarn speed is measured as the disturbance variable (Z).

12. The yarn false twist texturing process as defined in claim 11, wherein the correction step includes the steps of a) measuring the yarn tension (T) and the yarn speed (V) at a working point (B);

b) defining the slope (D) from the family of characteristics (T–VS) of the control zone; and c) determining a corrected controller constant (KR) from a predetermined performance graph of the controller.

13. The yarn false twist texturing process as defined in claim 1, wherein the correcting step occurs at defined time intervals.

14. The yarn false twist texturing process as defined in claim 1, wherein the correcting step includes the use of a controller constant.

* * * * *